US005153446A

United States Patent [19]

Shimomura

[11] Patent Number: 5,153,446

[45] Date of Patent: Oct. 6, 1992

[54] CONTROL APPARATUS OF ROTATIONAL SPEED OF ENGINE

[75] Inventor: Setsuhiro Shimomura, Hyogo, Japan

[73] Assignee: Mitsubishi Denki K.K., Tokyo, Japan

[21] Appl. No.: 799,723

[22] Filed: Nov. 22, 1991

Related U.S. Application Data

[63] Continuation of Ser. No. 520,481, May 8, 1990, abandoned.

[30] Foreign Application Priority Data

May 9, 1989 [JP] Japan ..... 1-116518
May 22, 1989 [JP] Japan ..... 1-129253

[51] Int. Cl.[5] ..... F02D 9/02; F02D 11/10; F02A 3/045

[52] U.S. Cl. ..... 290/40 C; 290/40 A; 290/40 R; 123/339

[58] Field of Search ..... 290/40 R, 40 A, 40 B, 290/40 C

[56] References Cited

U.S. PATENT DOCUMENTS 3,981,287 9/1976 Williams et al. ..... 290/40 A
4,307,690 12/1981 Rau et al. ..... 290/40 R
4,520,272 5/1985 Danno et al. ..... 290/40 A
4,611,560 9/1986 Miyazaki et al. ..... 290/40 A
4,633,093 12/1986 Otobe et al. ..... 290/40 A
4,649,878 3/1987 Otobe et al. ..... 290/40 R

FOREIGN PATENT DOCUMENTS 59-83600 5/1984 Japan .

*Primary Examiner*—Howard L. Williams
*Assistant Examiner*—Robert Lloyd Hoover
*Attorney, Agent, or Firm*—Sughrue, Mion, Zinn, Macpeak & Seas

[57] ABSTRACT

A control apparatus of a rotational speed of an engine outputs a drive signal for adjusting the opening of a control valve which controls a specific volume of intake air of the engine to control the engine speed. The drive signal is based on the sum of a basic control amount and a correction amount. The correction amount is varied such that an actual speed of the engine and a target speed tend to become equal during the idling condition. When the engine goes to the idling condition from the loaded condition, the drive signal is added to a predetermined value to provide a much larger value of the drive signal than in the normal idling condition, and is then progressively decreased until the sum becomes equal to said first control amount. Thus, the engine can be operated without too large a drop in engine speed.

4 Claims, 5 Drawing Sheets

CONTROL APPARATUS OF ROTATIONAL SPEED OF ENGINE

This is a continuation of Application Ser. No. 07/520,481 filed May 8, 1990, abandoned Jan. 6, 1992.

BACKGROUND OF THE INVENTION

Field of the Invention

Conventionally, there have been apparatuses for adjusting the specific volume of intake air of an automobile engine to control the engine speed to a desired value. The prior art apparatuses suffer from the problem that a sudden change in electrical load on a generator, which is driven by the engine, causes a change in torque load on the engine, resulting in a decrease in engine speed due to a time delay of the speed controlling operation.

Japanese Patent Preliminary Publication No. 59-83600 and U.S. Pat. No. 4,459,489 disclose apparatuses in which the output current of the generator slowly increases in response to the sudden increase in electrical load on the generator.

FIG. 4 illustrates the operation of one such prior art apparatus when a feedback control of the engine speed is being performed. A load signal M denotes the presence and absence of an electrical load on the generator. As soon as the generator is applied with an electrical load, the output voltage V of the generator drops and then slowly increases to the value before the load is applied; thus the output current i slowly increases. A feedback correction signal I denotes a feedback correction amount for bringing the difference between an actual speed and a desired speed of the engine, and is used to increase the specific volume of intake air in accordance with the increase in load on the generator such that the engine speed is maintained at the desired value. In this manner, when a large load is applied on the generator while the feedback control is being performed, the engine speed N can be maintained generally at a desirable condition though it undergoes little change.

The dotted lines in FIG. 4 show the responses of the output current i of the generator, the feedback control amount I, and the speed N which results if the output voltage of the generator is maintained constant rather than dropping as depicted by the solid line when the large load is applied. The sudden increase in the output current i as shown in the dotted line causes an increase of torque load on the engine which in turn causes the abrupt drop of the engine speed N. Meanwhile, the feedback correction amount I is applied with some delay time, therefore the engine speed N returns through a damped oscillation to the value before the large electrical load is applied. As mentioned above, in the prior art apparatus, too large a change in engine speed can be prevented when the electrical load is applied while the feedback control of the engine speed is being performed.

However, it should be noted that an automobile engine will encounter the following phenomenon. In FIG. 5, a signal S represents engine conditions, being L when the engine is idle and H when the engine is loaded. During the loaded condition, the feedback control of the engine speed is not carried out; therefore the feedback amount I is zero. At this time, if the electrical load M is applied to the generator, then the output current i of the generator slowly increases responding to the change in load and does not affect the engine speed since the engine output is inherently large at this time. As soon as the engine goes into the idling condition (i.e., S=L), the feedback control of the engine speed is begun but the engine speed N is no longer maintained constant, dropping rapidly as depicted in the solid line since the output current i being drawn from the generator is large enough to impose a heavy load on the engine. The feedback correction amount I slowly increases to cause an increase in the specific volume of intake air of the engine such that the decrease in the engine speed N may be recovered. Due to the delay time in feedback correction, the engine speed N approaches a target value through a damped oscillation.

As mentioned above, in the prior art speed control apparatus, the change in the engine speed N can be retarded when the electrical load is applied to the generator while the feedback control of the engine speed is being carried out, but the engine speed will change greatly if the feedback control of the engine speed is begun while the electrical load is being applied.

SUMMARY OF THE INVENTION

An object of the present invention is to provide a rotational speed control apparatus in which the rotational speed of an engine can be maintained even when the engine goes into the idling condition while an electrical load is being applied to a generator.

When the engine goes to the idling condition from the loaded condition, a predetermined amount of I1 much larger than the predetermined incremental amount $\Delta I$ is added to the feedback correction amount I to provide the drive signal of a much larger value than in the normal idling condition; thus the engine can be operated without too large a drop in engine speed. For example, as shown in FIG. 3, when the engine is in the idling condition (YES at steps 1004, 1005), the rotational speed signal N is compared with the target speed Nt to decide which one is greater than the other (steps 1009). Then, the predetermined amount of $\Delta I$ is subtracted from or added to the feedback correction amount I (steps 1010, 1012, 1011), depending on which is greater N or Nt. The feedback correction amount $I=I\pm\Delta I$, thus calculated, is then added to the basic control amount Cb to produce the drive signal C by which the bypass valve 5 then controls its opening to control the engine speed. The above-mentioned procedure is recursively performed upon a pulse sized from rotational speed detector 42 to adjust the engine speed so that the actual speed N becomes equal to the target speed Nt.

When the engine goes to the loaded condition from the idling condition, the value of the feedback correction amount I used during the idling condition is stored to provide for the next possible change from the loaded condition to the idling condition.

BRIEF DESCRIPTION OF THE DRAWINGS

Features and other objects of the invention will be more apparent from the detailed description of the preferred embodiments with reference to the accompanying drawings in which.

DETAILED DESCRIPTION OF THE PREFERRED EMBODIMENTS

First embodiment

Figure 1:
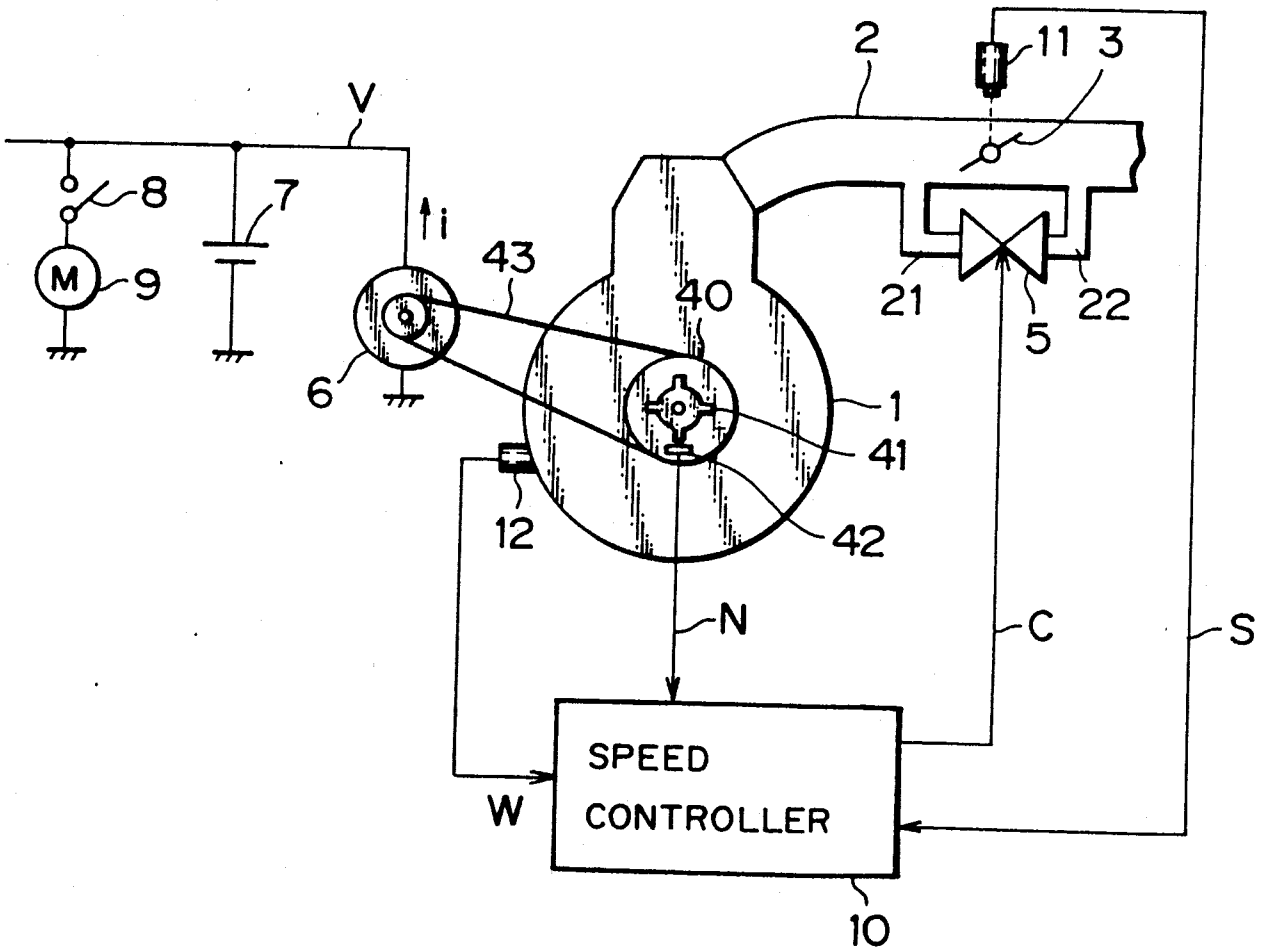
FIG. 1 is a diagram showing a general arrangement of control apparatus of the rotational speed of an engine according to the present invention.

FIG. 1 is a diagram showing a general arrangement of a control apparatus of the rotational speed of an engine according to the present invention. Air is supplied to an engine 1 through an inlet pipe 2 in which an inlet valve 3 is located to adjust the flow rate of air. A bypass tube 22 is connected at one end thereof to the upstream of the valve 3 in the inlet pipe 2 and at the other end thereof to the input side of a bypass control valve 5. A bypass tube 21 is connected at one end thereof to the downstream of the valve 3 in the inlet pipe 2 and at the other end thereof to the output side of the bypass control valve 5. The bypass control valve 5 controls the amount of air therethrough in accordance with a drive signal C from a speed controller 10. An idle switch 11 is operated, in interlocked relation with the valve 3, to close when the engine is in the idle condition. A pulley 40 is attached to an output shaft 1*a* of the engine 1 and drives a generator 6 by means of a belt 43. The generator 6 having a regulating apparatus is of the same type as disclosed by Japanese Patent Preliminary Publication No. 59-83600, in which the output current of the generator slowly increases in response to the sudden increase in electrical loads on the generator.

The output current of the generator 6 responds with some delay to the increase in electrical load. A gear 41 is magnetized at its teeth each of which activates a rotational-speed detector 42 to detect the engine speed when each one of the teeth passes by the rotational speed detector 42. Each one of the output pulses of rotational speed detector 42 triggers the control program of a speed controller 10, which will be described later. The battery 7 is connected in parallel with the generator 6. A series circuit of an electrical motor 9 and a switch 8 is connected in parallel with the battery 7. A temperature sensor 12 detects the temperature of cooling water of the engine. The speed controller 10 receives a rotational speed signal N from the rotational-speed detector 42, a signal S from the idle switch 11, and a water temperature signal W from the temperature sensor 12 to thereby manipulate these signals to output the drive signal C to the bypass control valve 5.

Figure 2:
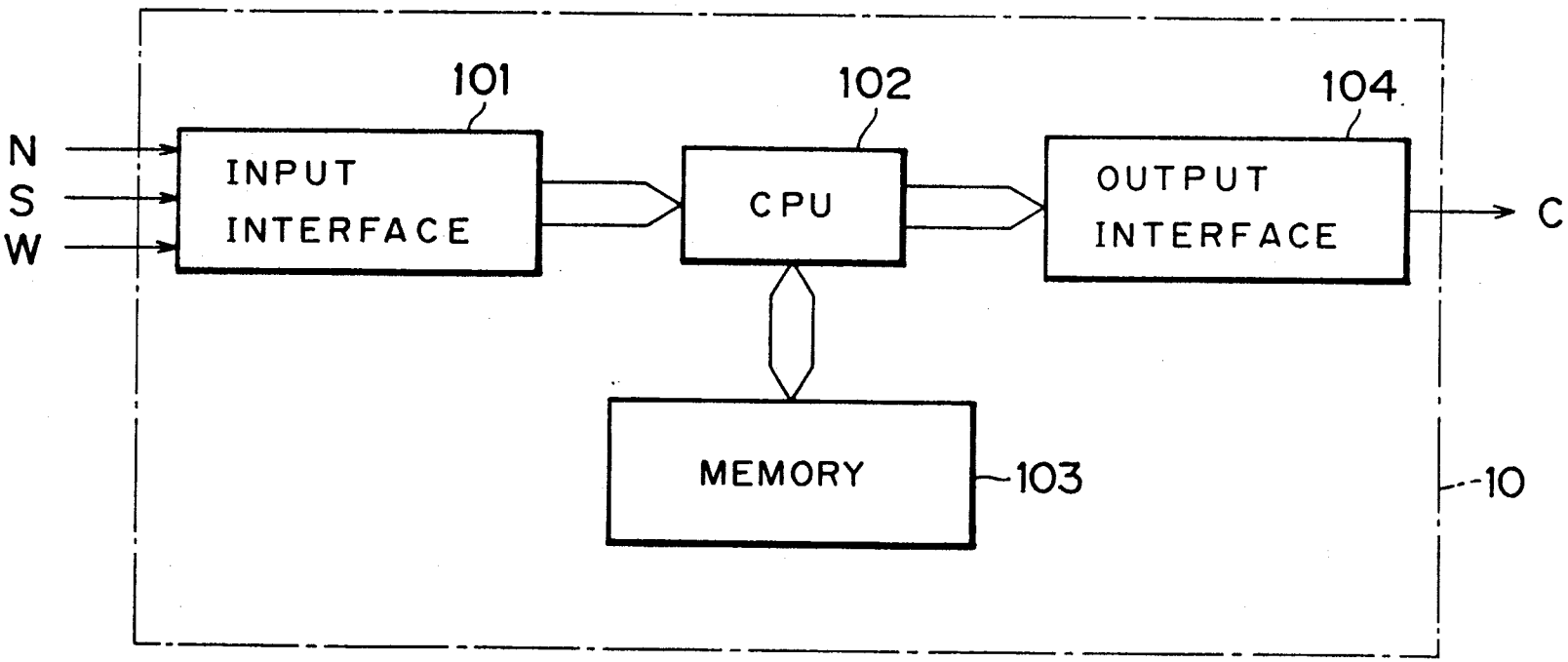
FIG. 2 is a block diagram showing the detail of the control apparatus in FIG. 1.

FIG. 2 shows an arrangement of the speed controller 10. An input interface 101 receives a rotational speed signal N from the rotational speed detector 42, a signal S from the idle switch 11, and the water temperature signal W from the temperature sensor 12. CPU 102 transmits and receives various data between a memory 103, as well as receives the signals through the interface 101 and performs arithmetic and logic operation to provide the drive signal C. The drive signal C is then power-amplified to a power level required for driving the bypass control valve 5 which is of a pulse-driven type. An output interface 104 amplifies the signal outputted from CPU 102 and outputs the drive signal C for driving a bypass control valve 5.

Figure 3:
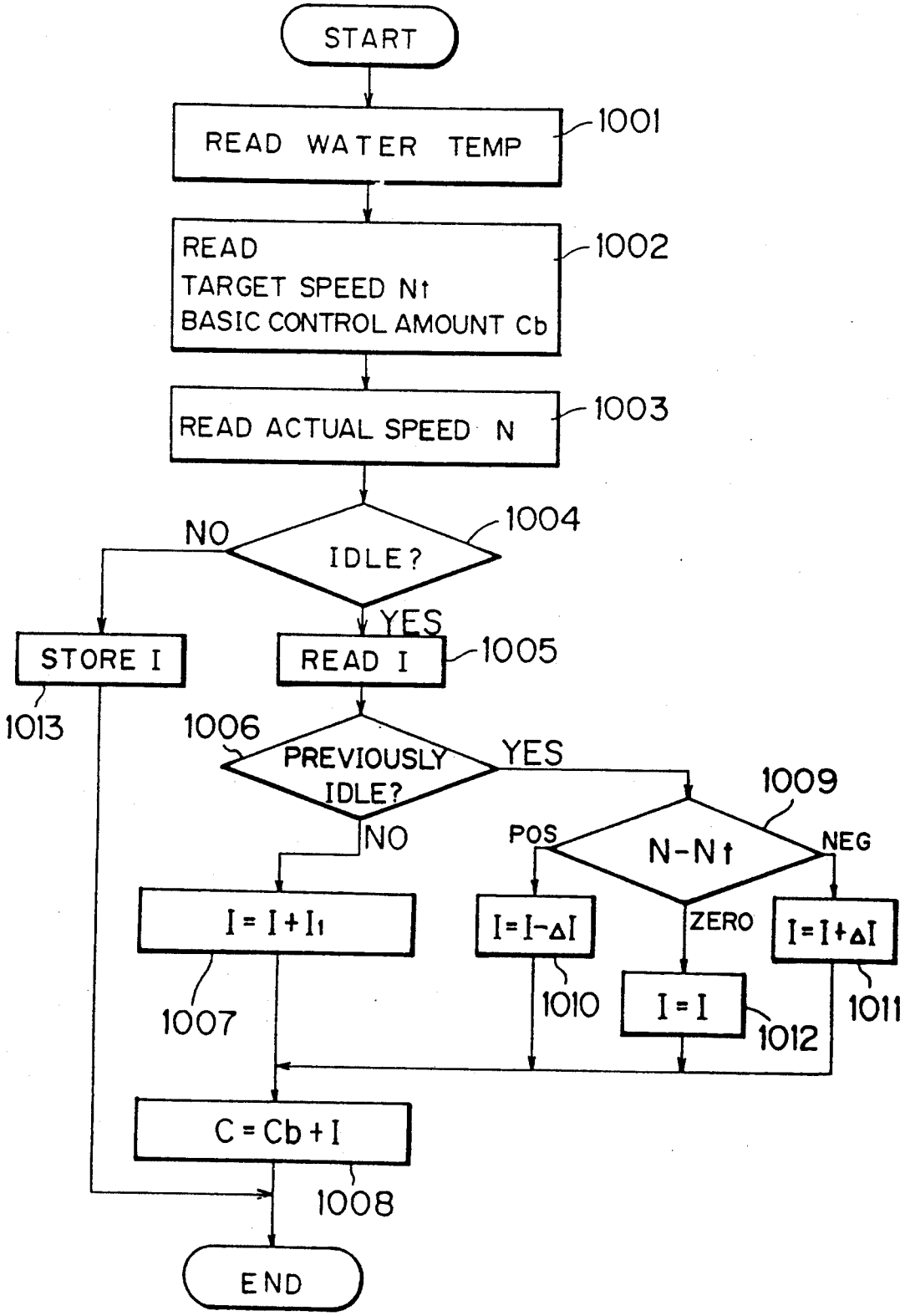
FIG. 3 is a flowchart showing the operation of a first embodiment of the control apparatus in FIG. 1.
Figure 4:
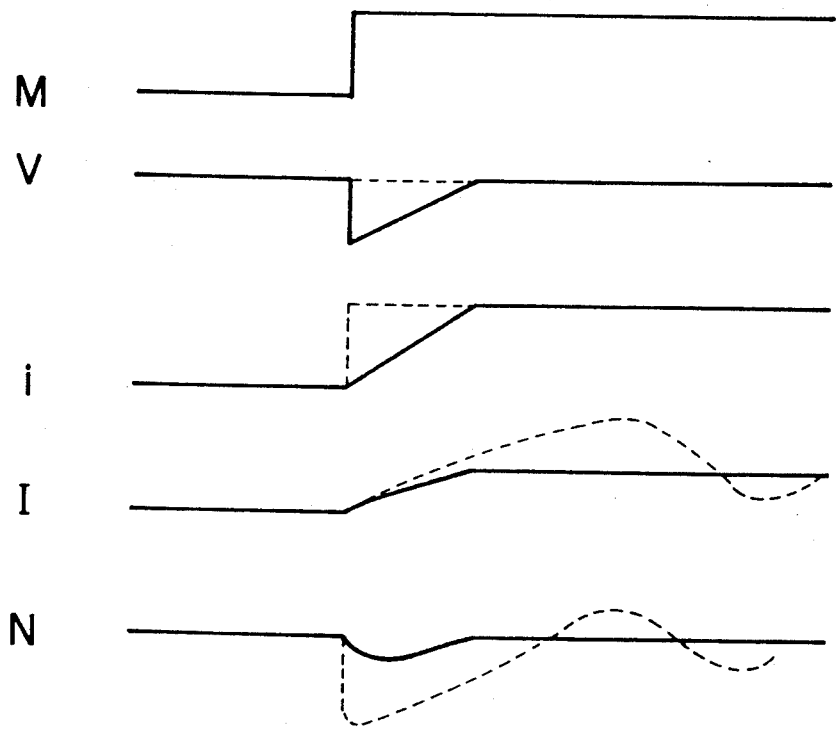
FIG. 4 is a diagram showing waveforms of various parameters of the engine conditions when the engine is in the idle condition.

FIG. 3 is a flowchart, illustrating the operation of a first embodiment of a rotational speed control apparatus of an engine according to the present invention. The program in FIG. 3 is triggered by each one of the output pulses from the rotational speed detector 42. The rotational speed control program is stored in the memory 103 and is executed by CPU 102. Upon a pulse input from the detector 42, the program is started. At step 1001, the water temperature signal W representative of the temperature of the engine cooling water is read in. At step 1002, CPU reads out from the memory 103 a basic control amount Cb and a target speed Nt for each value of the water temperature signal W. At step 1003, the actual speed N is read. At step 1004, CPU detects the condition of the idle switch 11 by reading the signal S to make a decision based on whether or not the engine 1 is in the idling condition. If the engine is in the idling condition, then, at step 1005 the feedback correction amount I is read. The value of I may be zero, resulted from the last normal idling operation. At step 1006, a decision is made based on whether or not the engine was previously in the idling condition. If the engine is still in the idling condition at step 1006, then the program proceeds to step 1009 to compare the actual speed N with the target speed Nt to decide which is greater than the other. If $N-Nt=0$, the feedback correction amount I is held at the previous value at step 1012; if $N>Nt$, the feedback correction amount I is updated by the feedback correction amount I minus an incremental amount $\Delta I$; if $N<Nt$, the feedback correction amount I is updated by the feedback correction amount I plus the incremental amount $\Delta I$. The correction amount $\Delta I$ is a predetermined experimental value.

Figure 5:
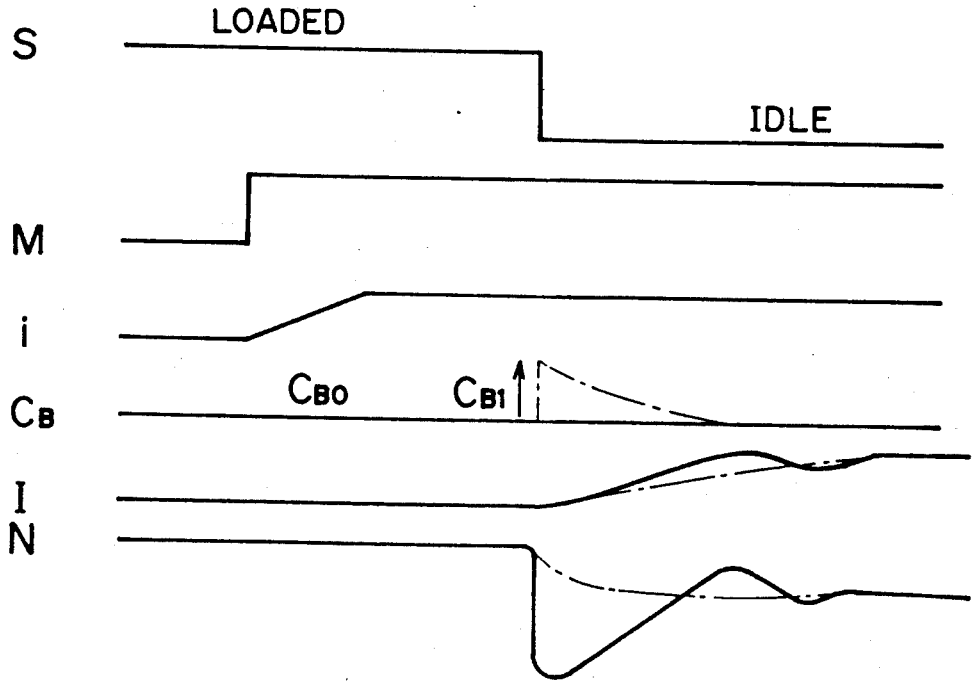
FIG. 5 is a diagram showing waveforms at various parameters of the engine when the engine goes from the loaded condition to the idle condition, dotted lines representing the present invention.

Meanwhile, if the engine is not previously in the idling condition at step 1006, then the program proceeds to step 1007 where the feedback correction amount I is updated by the present value I plus the predetermined amount I1, thereafter proceeds to step 1008 where the control signal $C=Cb+I$ is calculated. Then, the drive signal C is outputted to the valve 5. It should be noted that the magnitude of I1 is much greater than that of $\Delta I$. This large value of $I=I+I1$ is used as an initial value for the feedback control, which prevents the drop of the engine speed as shown in FIG. 5 shortly after the engine goes into the idling condition, ensuring the stable speed of the engine.

If the engine is not in the idling condition at step 1004, the program proceeds to step 1013 to hold a current feedback correction amount I. The program then waits for the next trigger pulse from the rotational speed detector 42 to start again.

While the values of $\Delta I$ at steps 1010 and 1011 have been described as being of the same value, these values may be different depending on the difference in sensitivity between when the engine speed is increased and when the engine speed is decreased. Selecting the value of $\Delta I$ in accordance with the magnitude of $N-Nt$ permits the smooth and rapid settlement of the feedback action. Further, setting a proper value of I1, in accordance with the initial values of the engine speed and the engine temperature or cooling water temperature allows an optimum control.

Operation of the first embodiment

When the engine goes to the idling condition from the loaded condition (YES at steps 1004 and 1005, NO at step 1006), the predetermined value of I1 much larger than the predetermined value ΔI is added to the feedback correction amount I to provide the drive signal much larger than in the steady idling condition. Thus, the engine can be operated without too large a drop in its speed. It should be noted the program does not directly make a decision based on whether or not the electrical load is on. However, the presence of the electrical load during idling period of the engine causes the drop in engine speed; therefore the speed-drop actually indicates the presence of the electrical load. When the engine is normally in the idling condition (YES at steps 1004, 1005), the rotational speed signal N is compared with the target speed Nt to decide which one is greater than the other (steps 1009.) Then the predetermined value of ΔI is subtracted from or added to the value of the feedback correction amount I (steps 1010, 1012, 1011.) The feedback correction amount $I'=I\pm\Delta I$, thus calculated, is then added to Cb to produce the drive signal C which is fed to the bypass valve 5. The bypass valve 5 then controls its opening to control the engine speed. The above-mentioned procedure is repeated to adjust the engine speed so that the actual speed N approaches and then approximates the target speed Nt.

When the engine goes to the loaded condition from the idling condition, the value of the feedback correction amount I is stored to provide for the next possible change from loaded condition to idling condition.

Second embodiment

Figure 6:
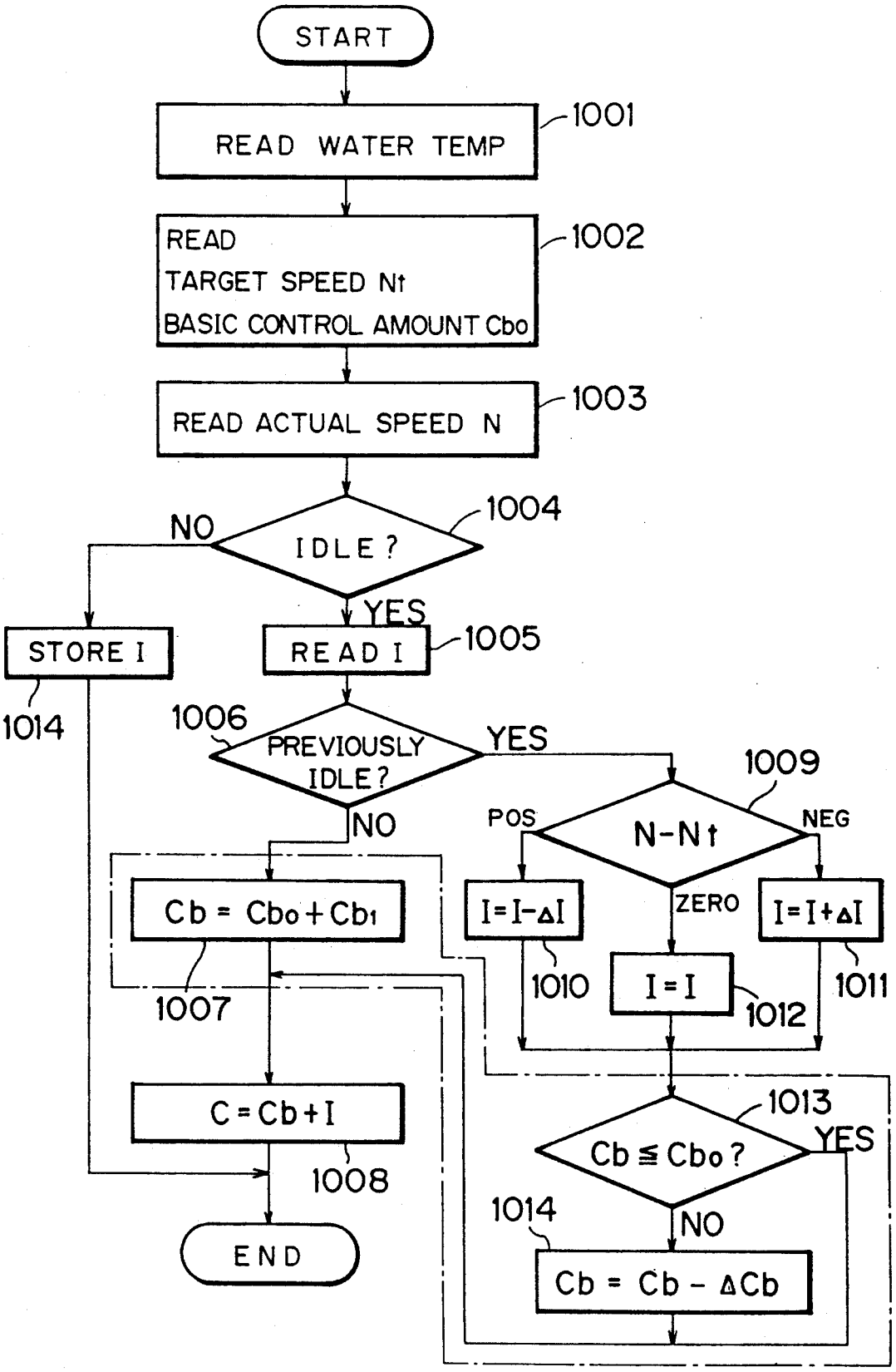
FIG. 6 is a flowchart showing the operation of a second embodiment of the control apparatus in FIG. 1.

FIG. 6 is a flowchart of the speed control program, illustrating the operation of a second embodiment of a rotational speed control apparatus of an engine according to the invention. The flowchart is triggered by each one of the output pulses from the rotational speed detector 42. The rotational speed control program is stored in the memory 103 and is executed by CPU 102. Upon a pulse input from the rotational speed detector 42, the program is started.

At step 1001, the water temperature signal W representative of the temperature of the engine cooling water is read in. At step 1002, CPU reads out from the memory 103 a basic control amount Cbo and a target speed Nt which has been stored in advance in the memory 103 for each value of the water temperature signal W, and at step 1003 the actual speed N is read in. At step 1005, CPU detects the condition of the idle switch 11 by reading the signal S to make a decision based on whether or not the engine 1 is in the idling condition. The value of I may be zero, resulting from the last normal idling operation. Then, at step 1006, a decision is made based on whether or not the engine was previously in the idling condition. If not, then the program proceeds to step 1007 to produce the basic control amount Cb by adding the present value Cbo to a predetermined amount Cb1, thereafter proceeds to step 1008.

Meanwhile, if the engine is still in the idling condition at step 1006, then the program proceeds to step 1009 to compare the actual speed N with the target speed Nt to decide which is greater than the other. If $N-Nt=0$, the feedback correction amount I is held at the previous value at step 1012; if $N>Nt$, the feedback correction amount I is updated by the feedback correction amount I minus an incremental amount ΔI at step 1010; if $N<Nt$, the feedback correction amount I is updated by the feedback correction amount I plus the incremental amount ΔI at step 1011. Then, at step 1013, a decision is made based on whether or not $Cb\leqq Cbo$. If $Cb\leqq Cbo$, then step 1008 is entered; if not $Cb\leqq Cbo$, then step 1014 is entered where Cb is updated by Cb minus ΔCb. Then, the program proceeds to step 1008 to calculate the drive signal $C=Cb+I$, which is outputted to the valve 5.

Thereafter, the program waits for the next trigger pulse from the rotational speed detector 42 to start again.

Operation of the second embodiment

When the engine goes to the idling condition from the loaded condition (YES at steps 1004 and 1005, NO at step 1006), the predetermined value of Cb1 is added to the first basic control amount Cbo to provide a second basic control amount Cb so that a drive signal C is much larger than in the idling condition. It should be noted that the program does not directly make a decision based on whether or not the electrical load is on. However, the presence of the electrical load during the idling period of the engine causes the drop in engine speed, therefore the speed-drop indicates the presence of the electrical load.

When the engine is normally in the idling condition (YES at steps 1004, 1005), the rotational speed signal N is compared with the target speed Nt to decide which one is greater than the other (steps 1009.) Then the predetermined incremental amount of ΔI is subtracted from or added to the value of the feedback correction amount I (steps 1010, 1011, 1012.) The relation between Cb1, ΔCb and ΔI is $Cb1>\Delta Cb>\Delta I$. The second basic control amount Cb is subtracted by a predetermined decremental amount ΔCb if Cb is not $Cb\leqq Cbo$. Then, the feedback correction amount (calculated at steps 1010, 1011, 1012) is added to Cb to produce the drive signal C which in turn is fed to the bypass valve 5 (step 1008.) The bypass valve 5 then controls its opening to control the engine speed. The above-mentioned procedure is repeated to adjust upon a pulse signal from the rotational speed detector 42, the engine speed so that the actual speed N approaches and then approximates the target speed Nt. The subtraction of the predetermined amount ΔCb is carried out for every cycle of the above-mentioned procedure until Cb is equal to Cbo.

Thus, the engine can be operated without too large a drop in engine speed.

When the engine goes to the loaded condition from the idling condition, the value of the feedback correction amount I is stored to provide for the next possible change from loaded condition to idling condition.

What is claimed is:

1. A control apparatus for controlling a rotational speed of an engine driving a generator, said control apparatus being adapted to delay an output of the generator when an electrical load is imposed thereon, said engine having a first operating condition corresponding to a relatively high rotational speed and the imposition of said electrical load, a second operating condition corresponding to an idling speed and the imposition of said electrical load, and a third operating condition corresponding to a transition period during which the engine changes from said first operating condition to said second operating condition, said control apparatus comprising:

means (11) for detecting said first, second, and third operating conditions;

memory means (103) for storing a target rotational speed (Nt) of the engine and a basic control amount (Cbo. Cb);

means (41, 42) for detecting an actual speed (N) of the engine;

means (10) for providing a correction signal (I) corresponding to a difference between the target rotational speed (Nt) and the actual speed (N) of the engine;

adjusting means (5) for adjusting a bypass volume of intake air to control said actual speed of the engine; and means (10) for setting a drive signal (C) for driving said adjusting means (5) for adjusting the bypass volume of intake air to control said actual speed of the engine, said drive signal (C) being based on said basic control amount (Cbo, Cb) and said correction signal (I) which is adjusted such that said actual speed (N) becomes equal to said target rotational speed (Nt) when the engine is in said second operating condition, said drive signal (C) being set to a larger value when said engine is in said third operating condition than that when said engine is operating in said second condition to prevent a drop in said actual engine speed while said engine is in said third operating condition, wherein when the operating condition of said engine changes back to said first operating condition from said second operating condition, a value of said correction signal used during said second operating condition is stored for use in a subsequent change of said engine from said first operating condition back to said second operating condition.

2. A control apparatus of rotational speed of an engine according to claim 1, wherein said basic control amount (Cbo) is added to a first predetermined amount (Cb1) to produce said larger value of said drive signal (C), and the sum (Cbo+Cb1) of said first predetermined amount (Cb1) and said basic control amount (Cbo) being progressively decreased until the sum (Cbo+Cb1) becomes equal to said first control amount (Cbo).

3. A control apparatus of rotational speed of an engine according to claim 1, wherein said correction amount (I) is added to a second predetermined amount (I1) to produce said larger value of said drive signal (C).

4. An apparatus according to claim 1, wherein the operating condition of said engine changes back to said first operating condition from said second operating condition, a value of said correction signal (I) used during said second operating condition is stored for use in a subsequent change of said engine from said first operating condition to said second operating condition.

* * * * *